US009982381B2

(12) United States Patent
Im et al.

(10) Patent No.: US 9,982,381 B2
(45) Date of Patent: May 29, 2018

(54) WASHING MACHINE AND METHOD OF CONTROLLING THE SAME

(71) Applicant: LG ELECTRONICS INC., Seoul (KR)

(72) Inventors: Myunghun Im, Seoul (KR); Sooyoung Oh, Seoul (KR); Jinho Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 14 days.

(21) Appl. No.: 14/827,824

(22) Filed: Aug. 17, 2015

(65) Prior Publication Data

US 2016/0053422 A1 Feb. 25, 2016

(30) Foreign Application Priority Data

Aug. 19, 2014 (KR) ..... 10-2014-0107866
Oct. 16, 2014 (KR) ..... 10-2014-0139966

(51) Int. Cl.
*D06F 33/02* (2006.01)
*D06F 35/00* (2006.01)
*D06F 39/08* (2006.01)

(52) U.S. Cl.
CPC ..... *D06F 33/02* (2013.01); *D06F 35/006* (2013.01); *D06F 39/085* (2013.01);
(Continued)

(58) Field of Classification Search
CPC ..... D06F 33/02; D06F 35/006; D06F 39/085; D06F 39/087; D06F 2202/085; D06F 2202/10; D06F 2204/065; D06F 2204/086
(Continued)

(56) References Cited

U.S. PATENT DOCUMENTS 6,134,925 A 10/2000 Fujii et al.
2008/0256722 A1* 10/2008 Oberkirsch ..... D06F 35/006 8/159
(Continued)

FOREIGN PATENT DOCUMENTS

CN 1222602 7/1999
CN 1464927 12/2003
(Continued)

OTHER PUBLICATIONS

European Search Report dated Nov. 30, 2015 issued in Application No. 15181431.6.
(Continued)

*Primary Examiner* — Levon J Shahinian
(74) *Attorney, Agent, or Firm* — KED & Associates, LLP

(57) ABSTRACT

Disclosed herein are a washing machine that is capable of having a reduced washing time and improved washing performance, and a method of controlling the same. The washing machine includes a tub accommodating wash water, a drum rotatably arranged in the tub and accommodating laundry, a drive unit for rotating the drum, a water supply unit for adjusting an inflow of the wash water, and a control unit, wherein the control unit drives the drive unit and detects an amount of the laundry so as to set a target water level, controls the water supply unit to supply the wash water into the tub such that the wash water is lower than the target water level, drives the drive unit to accelerate the drum at a rotational speed, and controls the water supply unit to supply the wash water into the tub until the target water level.

10 Claims, 13 Drawing Sheets

(52) U.S. Cl.
CPC ..... *D06F 39/087* (2013.01); *D06F 2202/085* (2013.01); *D06F 2202/10* (2013.01); *D06F 2204/065* (2013.01); *D06F 2204/086* (2013.01)

(58) Field of Classification Search
USPC ..... 8/158, 159; 68/12.04, 12.05, 12.12, 68/12.14
See application file for complete search history.

(56) References Cited

U.S. PATENT DOCUMENTS

| | | | | |
|---|---|---|---|---|
| 2011/0197638 | A1* | 8/2011 | Murrell | D06F 39/008 68/5 C |
| 2012/0192362 | A1* | 8/2012 | Lee | D06F 37/203 8/137 |

FOREIGN PATENT DOCUMENTS

| | | | |
|---|---|---|---|
| CN | 1609331 | | 4/2005 |
| CN | 1969077 | | 5/2007 |
| CN | 103243513 | | 8/2013 |
| EP | 1 983 088 | | 10/2008 |
| EP | 1 983 088 | A1 | 10/2008 |
| WO | WO 2006/101362 | A1 | 9/2006 |

OTHER PUBLICATIONS

Chinese Office Action dated Jan. 18, 2017 issued in Application 201510507466.5 (English translation attached).

* cited by examiner

WASHING MACHINE AND METHOD OF CONTROLLING THE SAME

CROSS-REFERENCE TO RELATED PATENT APPLICATIONS

This application claims priority under 35 U.S.C. § 119 to Korean Application No. 10-2014-0107866, filed on Aug. 19, 2014, and Korean Application No. 10-2014-0139966, filed on Oct. 16, 2014, whose entire disclosures are hereby incorporated by reference.

BACKGROUND OF THE INVENTION

1. Field of the Invention

The present invention relates to a washing machine and a method of controlling the same, and more particularly to a washing machine having a reduced washing time, and a method of controlling the same.

2. Description of the Related Art

In general, washing machines are apparatuses for washing clothes, bedding, etc. (hereinafter, referred to as "laundry") using water, detergent, and mechanical action through processes such as washing, rinsing, and dehydration, in order to remove contaminants from laundry.

Washing machines are classified into an agitator type washing machine, a pulsator type washing machine, and a drum type washing machine.

The agitator type washing machine rotates a washing rod, which protrudes from the center of a washing container, in clockwise and counterclockwise so as to wash laundry. The pulsator type washing machine rotates a disk rotary blade, which is formed at the lower portion of a washing container, in clockwise and counterclockwise directions so as to wash laundry using frictional force between a water stream and the laundry. The drum type washing machine rotates a drum accommodating water, detergent, and laundry therein so as to wash laundry.

The drum type washing machine includes a tub mounted inside a cabinet defining the external appearance thereof for accommodating wash water, a drum arranged inside the tub for accommodating laundry, a drive part mounted to the back surface of the tub to rotate the drum, and a drive shaft installed at the drive part to be connected to the back surface of the drum through the tub. A lifter is mounted inside the drum and lifts laundry when the drum rotates.

The drum type washing machine is required to have a reduced washing time and improved washing performance.

SUMMARY OF THE INVENTION

Therefore, the present invention has been made in view of the above problems, and it is an object of the present invention to provide a washing machine that is capable of having a reduced washing time and improved washing performance, and a method of controlling the same.

It is another object of the present invention to provide a washing machine that is capable of having a reduced washing time by performing a high-concentration washing process during supply of wash water and performing a rinsing process during dehydration, and a method of controlling the same.

It is another object of the present invention to provide a washing machine that enables wash water to flow into a drum from a tub by rotation of the drum in a state in which a level of wash water in the tub is low, and a method of controlling the same.

It is another object of the present invention to provide a washing machine that makes detergent dissolved in wash water have a high concentration by inserting the detergent in a state in which a level of wash water in the tub is low, thereby enabling laundry in a drum to be completely wet with wash water, and a method of controlling the same.

It is a further object of the present invention to provide a washing machine that enables wash water to flow into a drum from a tub without using a circulation pump, and a method of controlling the same.

The present invention is not limited to the foregoing objects, and the other objects thereof will be clearly understood by those skilled in the art from the following description.

In accordance with an aspect of the present invention, the above and other objects can be accomplished by the provision of a washing machine including a tub accommodating wash water, a drum rotatably arranged in the tub and accommodating laundry, a drive unit for rotating the drum, a water supply unit for adjusting an inflow of the wash water from an external water source, and a control unit for controlling the drive unit, the water supply unit, and a pump, wherein the control unit drives the drive unit and detects an amount of the laundry accommodated in the drum so as to set a target water level, controls the water supply unit to supply the wash water into the tub such that a level of the wash water is lower than the target water level, drives the drive unit to accelerate the drum at a rotational speed in a state in which the laundry is attached to the drum, and controls the water supply unit to supply the wash water into the tub until the target water level.

In accordance with another aspect of the present invention, there is provided a method of controlling a washing machine including a tub accommodating wash water, and a drum rotatably arranged in the tub and accommodating laundry. The method includes performing laundry amount detection of setting a target water level by rotating the drum and detecting an amount of the laundry accommodated in the drum, performing initial water supply of supplying the wash water into the tub such that a level of the wash water is lower than the target water level, performing high-concentration washing of accelerating the drum at a rotational speed in a state in which the laundry is attached to the drum, and performing additional water supply of supplying the wash water into the tub until the target water level.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to embodiments, examples of which are illustrated in the accompanying drawings. However, the present invention may be embodied in many different forms and should not be construed as limited to the embodiments set forth herein. Rather, these embodiments are provided so that this disclosure will be thorough and complete, and will fully convey the scope of the invention to those skilled in the art. Wherever possible, the same reference numbers will be used throughout the drawings to refer to the same or like parts.

Hereinafter, a washing machine and a method of controlling the same according to exemplary embodiments of the present invention will be described with reference to the drawings.

Figure 1:
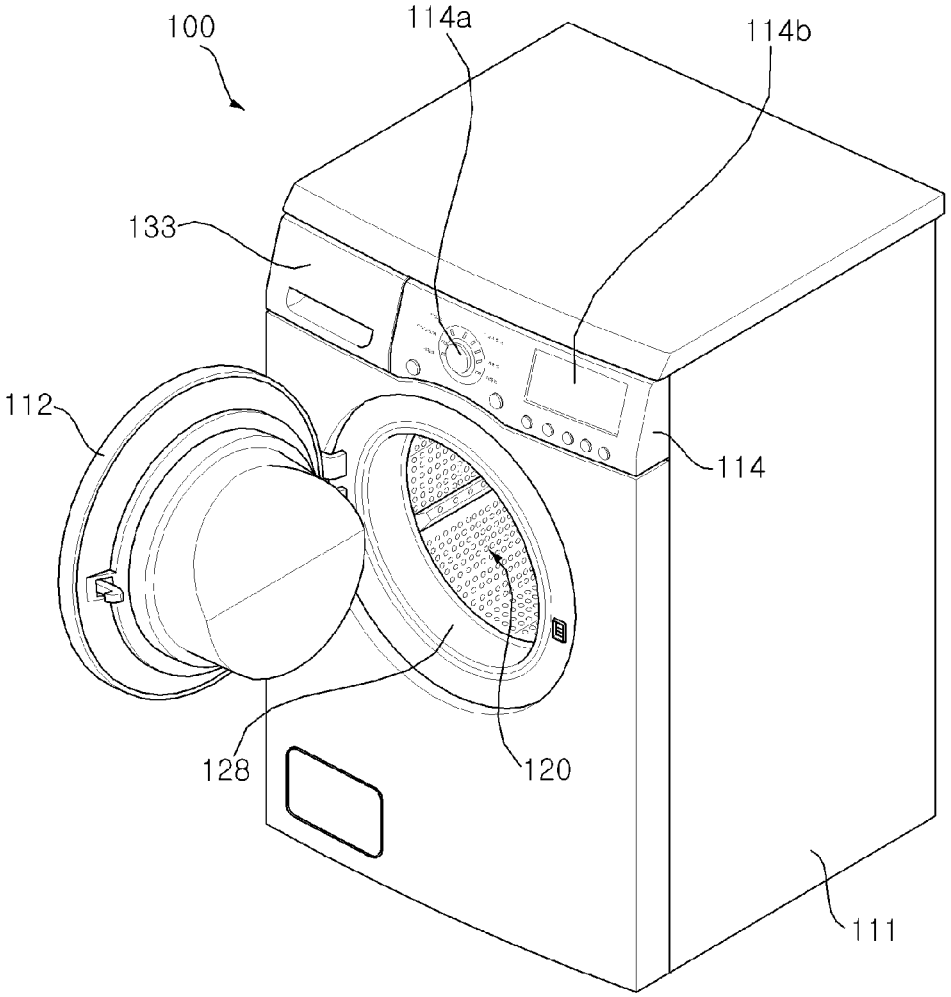
FIG. 1 is a perspective view illustrating a washing machine according to an embodiment of the present invention.
Figure 2:
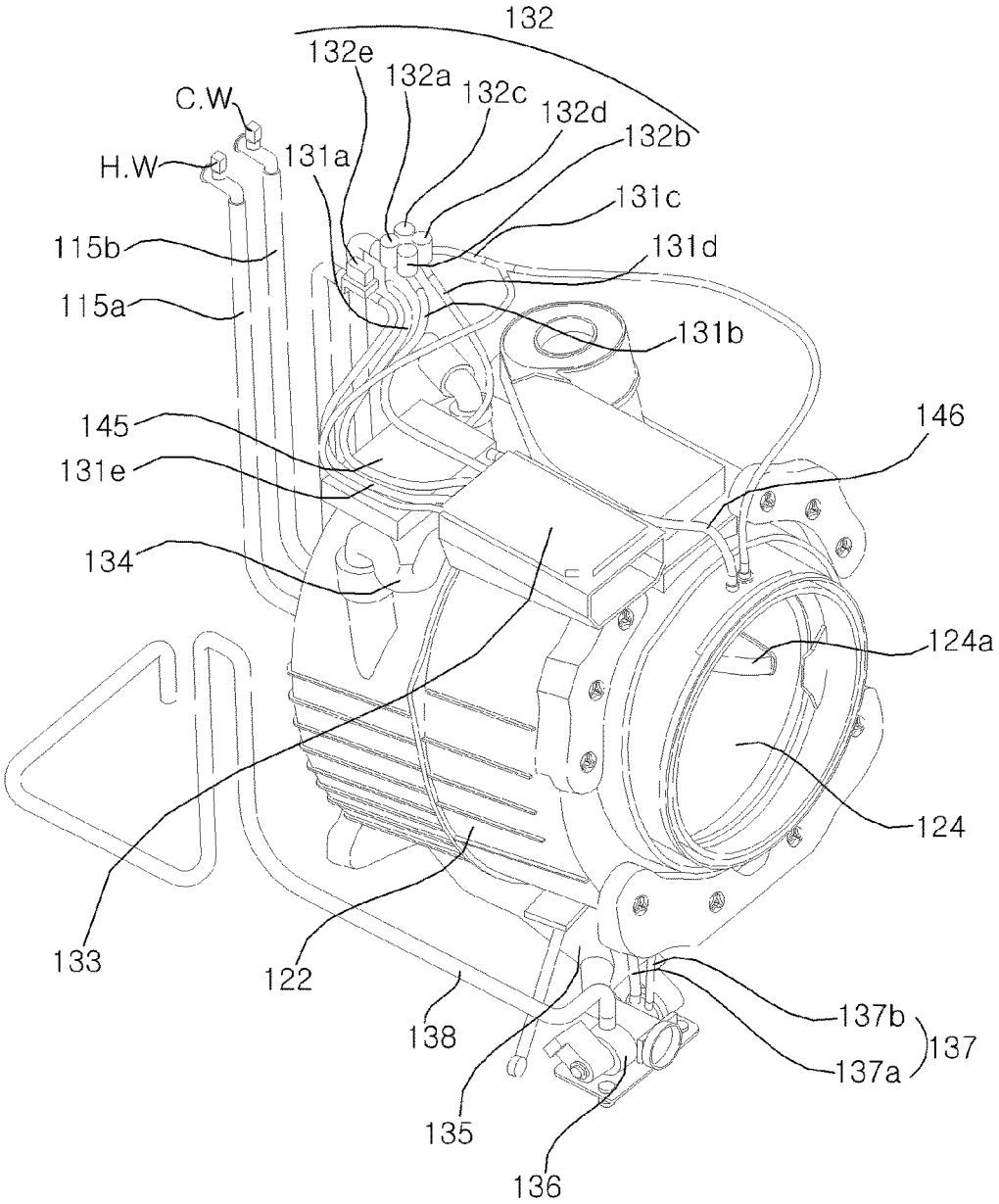
FIG. 2 is a perspective view illustrating an internal structure of the washing machine illustrated in FIG. 1.
Figure 3:
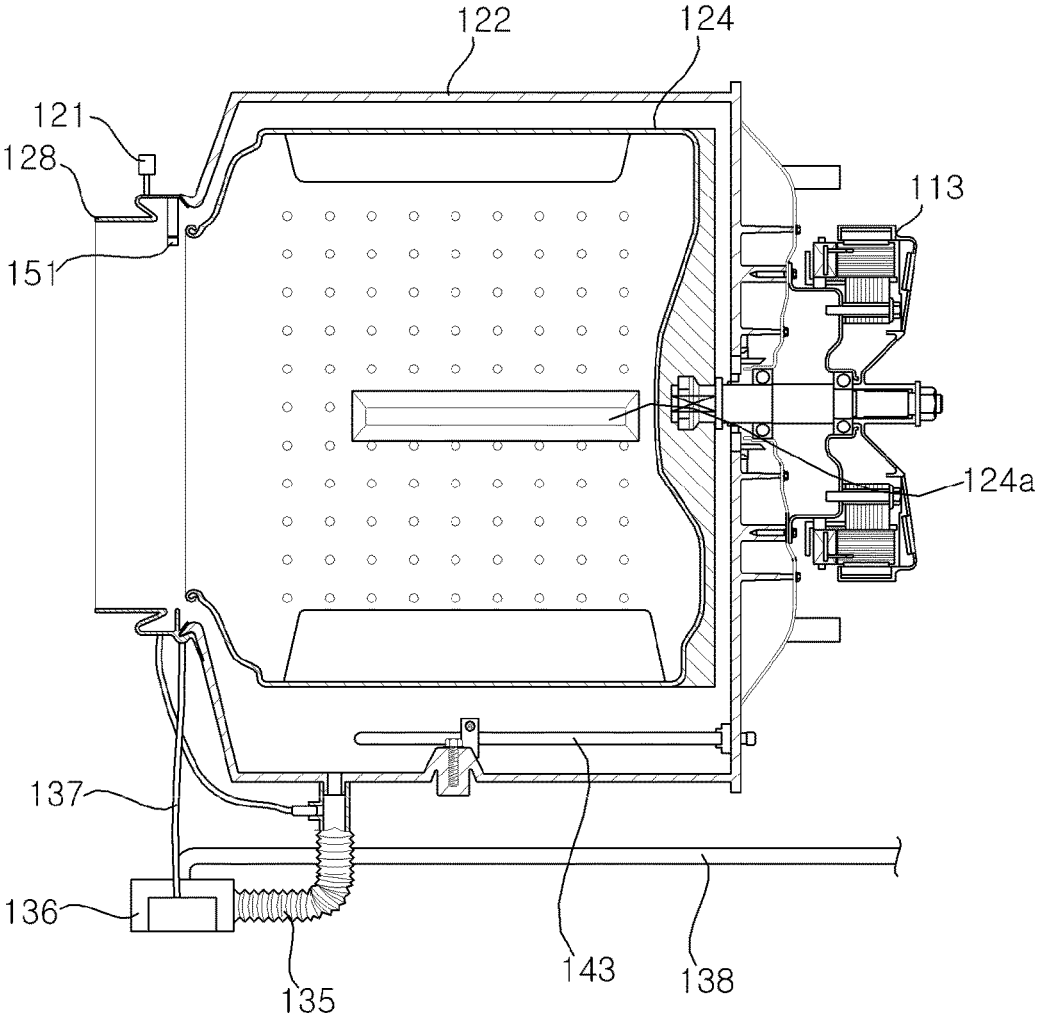
FIG. 3 is a cross-sectional view illustrating a portion of the washing machine illustrated in FIG. 1.
Figure 4:
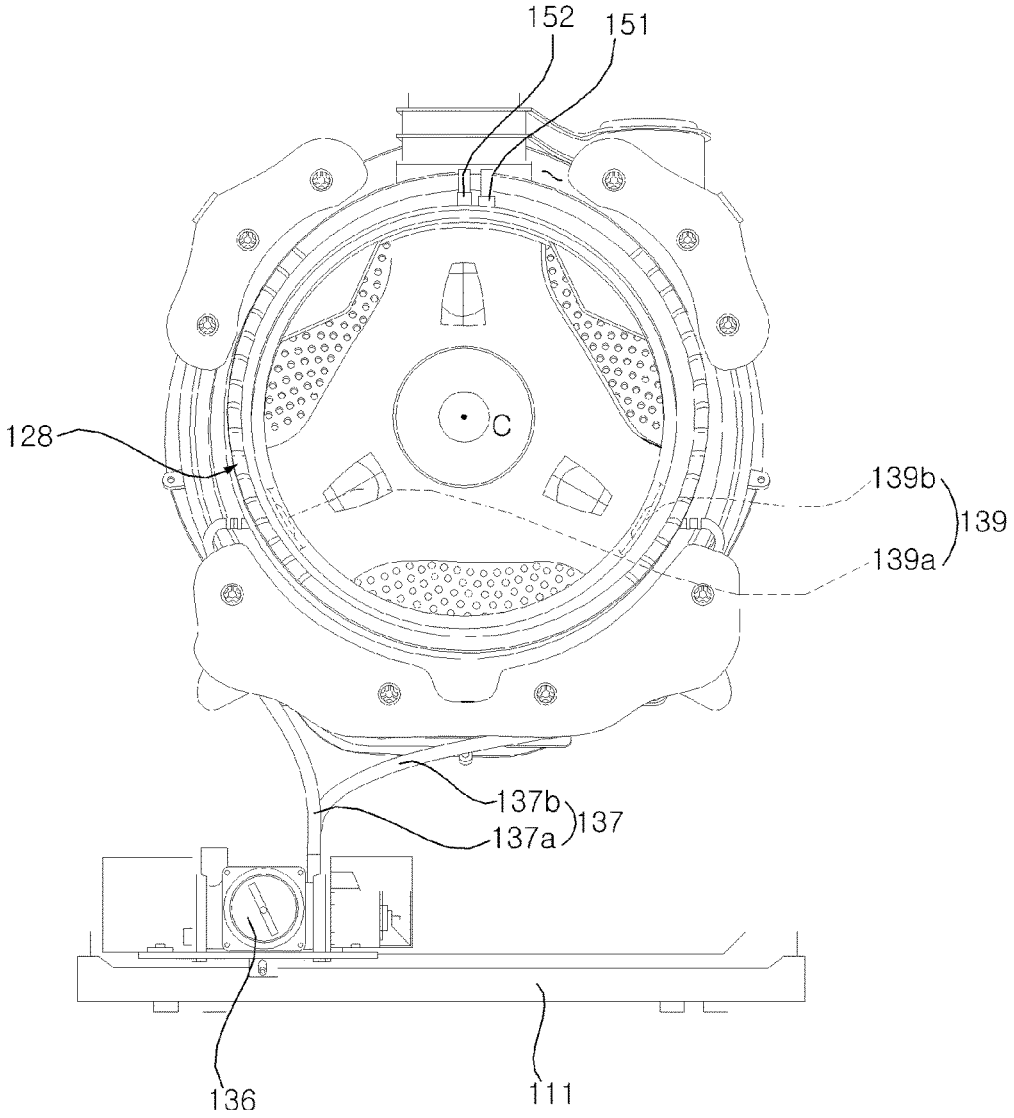
FIG. 4 is a front view illustrating the internal structure of the washing machine illustrated in FIG. 1.

FIG. 1 is a perspective view illustrating a washing machine according to an embodiment of the present invention. FIG. 2 is a perspective view illustrating an internal structure of the washing machine illustrated in FIG. 1. FIG. 3 is a cross-sectional view illustrating a portion of the washing machine illustrated in FIG. 1. FIG. 4 is a front view illustrating the internal structure of the washing machine illustrated in FIG. 1.

The washing machine, which is designated by reference numeral 100, according to the embodiment of the present invention includes a cabinet 111 defining the external appearance thereof, a tub 122 accommodating wash water, a drum 124, which is rotatably arranged in the tub and accommodates laundry, a drive unit 113 for rotating the drum, a water supply unit 132 for adjusting the inflow of wash water from an external water source, an injection nozzle 151 for spraying the wash water, which is supplied from the external water source by the water supply unit 132, into the drum 124, a detergent box 133 accommodating washing detergent to mix wash water with the washing detergent, a pump 136 for pumping and circulating the wash water in the tub, and a circulation nozzle 139 for spraying the wash water circulated by the pump 136 into the drum.

The cabinet 111 defines the external appearance of the washing machine. The tub 122 is provided inside the cabinet 111. The cabinet 111 has a laundry entry port 120 for the insertion and removal of laundry. A door 112 is rotatably provided on the front surface of the cabinet 111 such that the laundry entry port 120 is openable and closable. The cabinet 111 is provided with a control panel 114 through which a user inputs commands so that information on various states of the washing machine 100 is displayed on the control panel. The detergent box 133, which accommodates detergent such as washing detergent, rinsing detergent, or bleach, is withdrawably provided inside the cabinet 111.

The tub 122 is arranged in the cabinet 111 so as to absorb a shock by a spring (not shown) and a damper (not shown). The tub 122 accommodates wash water. The drum 124 is arranged inside the tub 122.

The tub 122 may have a water level sensor 121 for detecting the level of wash water accommodated in the tub. The water level sensor 121 may be realized in various manners. In the embodiment, the water level sensor 121 changes a distance between electrodes using variation in air pressure according to the level of wash water, and thus measures a water level using a change in capacitance of the electrodes. A heater 143 for heating wash water may be provided inside the tub 122.

The drum 124 accommodates laundry and rotates. The drum 124 has a plurality of through-holes **124*b* for the passage of wash water. A lifter 124*a*, which lifts laundry to a certain height during the rotation of the drum 124, may be arranged on the inner wall of the drum 124. The drum 124 is rotated by rotational force transferred from the drive unit 113**.

The drum 124 is not perfectly horizontally arranged, but may be arranged to have a predetermined gradient such that the rear portion of the drum 124 is inclined downward.

A gasket 128 is provided between the tub 122 and the cabinet 111 to seal a gap therebetween. The gasket 128 is disposed between the inlet of the tub 122 and the laundry entry port 120. The gasket 128 absorbs shocks transferred to the door 112 when the drum 124 rotates, and simultaneously prevents the wash water in the tub 122 from leaking to the outside.

The gasket 128 may be integrally made of a single material, but the portion of the gasket 128, which is fastened to the tub 122, is made of a rigid material in order to secure sufficient fastening strength and stiffness between the gasket 128 and the tub 122. The portion of the gasket 128, which is fastened to the tub 122, may be made of a material having elasticity in order to attenuate vibration transferred from the tub 122 to the cabinet 111.

The gasket 128 is provided with the injection nozzle 151 and the circulation nozzle 139 for introducing wash water into the drum 124, and a steam nozzle 152 for spraying steam into the drum 124.

The drive unit 113 rotates the drum 124. The drive unit 113 may rotate the drum 124 at various speeds or in various directions. The drive unit 113 may include a motor, a switching element, a clutch, etc. The drive unit 113 may be a sensor for measuring the actual rotational speed of the drum 124.

The detergent box 133 accommodates detergent such as washing detergent, rinsing detergent, or bleach. The detergent box 133 is preferably provided to be withdrawal from the front surface of the cabinet 111. The detergent in the detergent box 133 is mixed with wash water during the supply of the wash water, and is then introduced into the tub 122. The detergent box 133 may be divided into a washing detergent accommodation part, a rinsing detergent accommodation part, and a bleach accommodation part.

The washing machine 100 is connected to a hot water source H.W through a hot water hose 115*a* for supplying hot water from an external water source, and is connected to a cold water source C.W through a cold water hose 115*b* for supplying cold water from an external water source. Water introduced through the hot water hose 115*a* and the cold water hose 115*b* is supplied to the detergent box 133, the steam unit 145, and/or the injection nozzle 151 by suitable control of the water supply unit 132.

The cabinet 111 is provided therein with a water supply unit 132, which is connected to the hot water hose 115*a* and the cold water hose 115*b* to adjust the inflow of wash water from the external water source, first and second water supply hoses 131*a* and 131*b*, which are connected to the water supply unit 132 so as to guide wash water, supplied from the cold water source C.W, to the detergent box 133 according to the operation of the water supply unit 132, and a third water supply hose 131*c*, which is connected to the water supply unit 132 so as to guide wash water, supplied from the cold water source C.W, to the injection nozzle 151 and the detergent box 133 according to the operation of the water supply unit 132. The third water supply hose 131*c* is branched from the water supply unit 132 and is then connected to each of the injection nozzle 151 and the detergent box 133.

In addition, the cabinet 111 is provided therein with a fourth water supply hose 131*d*, which is connected to the water supply unit 132 so as to guide wash water, supplied from the cold water source C.W, to the steam unit 145 according to the operation of the water supply unit 132, and a fifth water supply hose 131*e*, which is connected to the water supply unit 132 so as to guide hot wash water, supplied from the hot water source H.W, to the detergent box 133 according to the operation of the water supply unit 132.

The cabinet 111 is preferably provided therein with a water supply pipe 134 through which wash water mixed with detergent in the detergent box 133 is introduced into the tub 122.

The water supply unit 132 includes a free valve 132*a* connected to the first water supply hose 131*a*, a main valve 132*b* connected to the second water supply hose 131*b*, a bleach valve 132*c* connected to the third water supply hose 131*c*, a steam valve 132*d* connected to the fourth water supply hose 131*d*, and a hot water valve 132*e* connected to the fifth water supply hose 131*e* to adjust the inflow of hot wash water.

When the free valve 132*a* is opened, wash water is supplied to the detergent box 133 through the second water supply hose 131*b*. The wash water supplied by the free valve 132*a* is mixed with preliminary washing detergent by passing through the detergent accommodation portion of the detergent box 133, and is then supplied into the tub 122 through the water supply pipe 134. If no preliminary washing detergent is present in the detergent box 133, the wash water supplied by the free valve 132*a* is supplied into the tub 122 through the water supply pipe 134 without being mixed with preliminary washing detergent.

When the main valve 132*b* is opened, wash water is supplied to the detergent box 133 through the second water supply hose 131*b*. The wash water supplied by the main valve 132*b* is mixed with washing detergent by passing through the detergent accommodation portion of the detergent box 133, and is then supplied into the tub 122 through the water supply pipe 134.

When the bleach valve 132*c* is opened, wash water is supplied to the injection nozzle 151 and the detergent box 133 through the third water supply hose 131*c*. A portion of the wash water supplied by the bleach valve 132*c* is sprayed into the drum 124 through the injection nozzle 151. The other portion of the wash water supplied by the bleach valve 132*c* is mixed with bleach in the detergent box 133, and is then supplied into the tub 122 through the water supply pipe 134. If no bleach is present in the detergent box 133, the wash water supplied by the bleach valve 132*c* is supplied into the tub 122 through the water supply pipe 134 without being mixed with bleach.

When the steam valve 132*d* is opened, wash water is supplied to the steam unit 145 through the fourth water supply hose 131*d*. The wash water supplied by the steam valve 132*d* is heated by the steam unit 145 to be converted into steam. The steam generated by the steam unit 145 is supplied to the steam nozzle 152 through a steam supply hose 130, and is then sprayed into the drum 124 through the steam nozzle 152.

When the hot water valve 132*e* is opened, hot wash water is supplied to the detergent box 133 through the fifth water supply hose 131*e*. The wash water supplied by the hot water valve 132*e* passes through the detergent box 133, and is then supplied into the tub 122 through the water supply pipe 134.

The cabinet 111 is provided therein with a drain pipe 135 through which the wash water in the tub 122 is discharged, a pump 136 for discharging the wash water in the tub 122, a circulation hose 137 connected to the circulation nozzle 139 so as to spray the circulated wash water into the drum 124, and a drain hose 138 through which wash water is discharged to the outside.

The pump 136 discharges the wash water in the tub 122. The pump 136 discharges the wash water, which is discharged from the tub 122 through the drain pipe 135, to the outside through the drain hose 138, or circulates the wash water in the tub through the circulation hose 137. In the embodiment, the pump 136 may include a circulation pump and a drain pump, which are respectively connected to the circulation hose 137 and the drain hose 138.

The circulation hose 137 connects the pump 136 to the circulation nozzle 139. The wash water discharged from the tub 122 by the pump 136 is sprayed into the drum 124 from the circulation nozzle 139 through the circulation hose 137.

The control panel 114 may include an input part 114*b*, to which the user inputs a selected washing course or various operation commands such as the operation time and reservation for each process, and a display part 114*a* for displaying the state of operation of the washing machine 100.

Washing courses include a standard course, a lingerie/wool course, a boiling course, a speed wash course, a functional clothes course, a laundry damage prevention course, a silent course, an energy saving course, and the like, according to the type or function of laundry. The operation of the washing machine 100 is divided into a washing process, a rinsing process, and a dehydration process. In each process, a water supply step, a washing step, a rinsing step, a drain step, a dehydration step, a drying step, or the like is performed.

The injection nozzle 151 is provided in the gasket 128 to spray wash water into the drum 124. The injection nozzle 151 is provided adjacent to the steam nozzle 152. The injection nozzle 151 is connected to the first water supply hose 131*a* so as to spray wash water, which is supplied from the external water source, into the drum 124.

The injection nozzle 151 is preferably provided at the upper portion of the gasket 128. In the embodiment, the injection nozzle 151 may be disposed at any position, e.g. at the lower portion of the gasket 128, between the gasket 128 and the cabinet 111, at the cabinet 111, or at the tub 122.

The injection nozzle 151 is preferably an atomizing nozzle which atomizes wash water to spray the atomized wash water onto the side and rear surfaces of the drum 124.

The steam nozzle 152 is provided in the gasket 128 to spray wash water into the drum 124. The steam nozzle 152 is connected to a steam hose 146 so as to spray steam generated by the steam unit 145 into the drum 124.

The steam nozzle 152 is provided at the upper portion of the gasket 128 to be adjacent to the injection nozzle 151. In the embodiment, the steam nozzle 152 may be disposed at any position, e.g. at the lower portion of the gasket 128, between the gasket 128 and the cabinet 111, at the cabinet 111, or at the tub 122.

The circulation nozzle 139 is provided in the gasket 128 to spray wash water circulated by the pump 136 into the drum 124. The circulation nozzle 139 is connected to the circulation hose 137 so as to spray wash water circulated by the pump 136 into the drum 124. The circulation nozzle 139 may be integrally formed with the gasket 128.

The circulation nozzle 139 is preferably provided beneath the rotary shaft of the drum 124 so that wash water is sprayed upward. The circulation nozzle 139 may be configured as a plurality of circulation nozzles, and two circulation nozzles may be arranged at both sides of the lower portion of the gasket 128. It is preferable that a first circulation nozzle 139*a* be provided at the left lower portion of the gasket 128 to spray wash water into the drum 124 in a right upward direction, and a second circulation nozzle 139*b* be provided at the right lower portion of the gasket 128 to spray wash water into the drum 124 in a left upward direction.

When the circulation nozzle 139 is configured as a plurality of circulation nozzles, the circulation hose 137 is configured as a plurality of circulation hoses. In this case, it is preferable that a first circulation hose 137*a* be connected to the first circulation nozzle 139*a*, and a second circulation hose 137*b* be connected to the second circulation nozzle 139*b*.

Wash water accommodated in the drum 124 moves to the pump 136 along the drain pipe 135 provided in the tub 122. The pump 136 allows wash water to reach the circulation nozzle 139 through the circulation hose 137. Wash water is sprayed into the drum 124 through the circulation nozzle 139 to be introduced into the tub 122.

Figure 5:
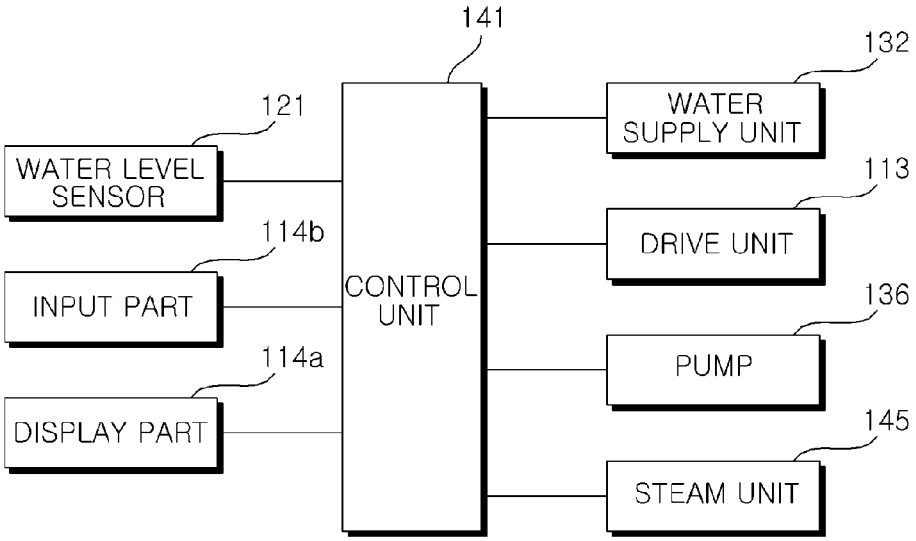
FIG. 5 is a block diagram illustrating the washing machine according to the embodiment of the present invention.

FIG. 5 is a block diagram illustrating the washing machine according to the embodiment of the present invention.

A control unit 141 controls the overall operation of the washing machine in response to the operation command input to the input part 114*b*. The control unit 141 is preferably provided in the control panel 114. The control unit 141 may consist of a microprocessor for controlling the operation of the washing machine, a storage device, and other electronic devices. The control unit 141 determines whether each process proceeds, or whether operations, such as water supply, washing, rinsing, drainage, and dehydration, are performed in each process, the operation time, and the number of times of repetition, according to the washing course selected by the user, so as to operate the washing machine.

The control unit 141 receives the wash water level measured by the water level sensor 121, and treats the same. The control unit 141 receives the rotational speed of the drum 124 measured by the drive unit 113, and treats the same. The control unit 141 receives operation commands from the input part 114*b*, and displays the state of operation of the washing machine 100 on the display part 114*a*. The control unit 141 controls the water supply unit 132, the drive unit 113, the pump 136, and the steam unit 145 according to the selected course or other operation commands.

Figure 6:
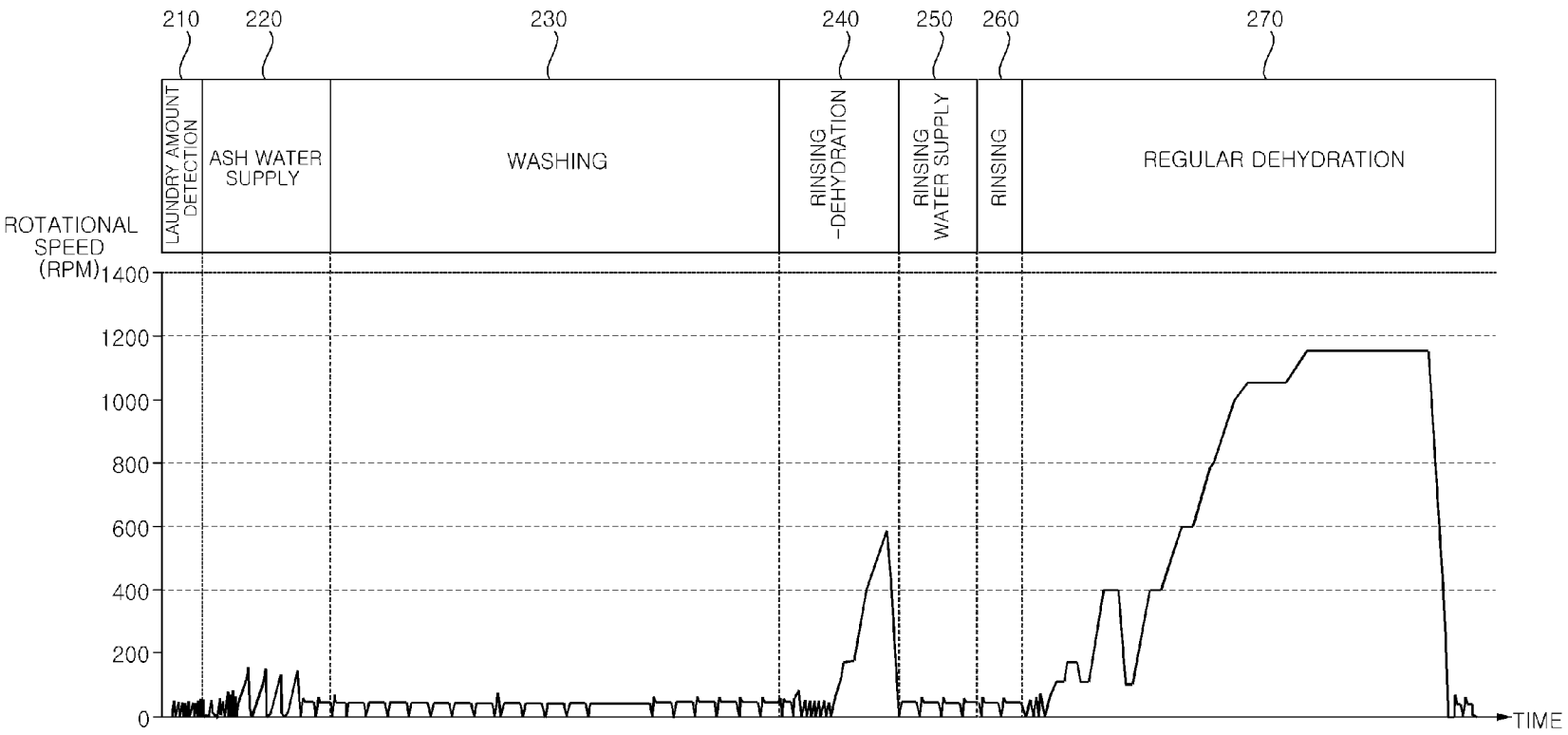
FIG. 6 is a view illustrating an entire process of a washing method in the washing machine according to the embodiment of the present invention.

FIG. 6 is a view illustrating an entire process of a washing method in the washing machine according to the embodiment of the present invention.

The washing method according to the embodiment of the present invention may be performed when the user selects a speed wash course through the control panel 114, or a command for the execution of the speed wash course is input the control unit 141 according to the input or determination of the user. In some embodiments, a typical washing course may be a washing method to be described later.

A laundry amount detection step 210 is a step of detecting an amount of laundry (hereinafter, referred to as a "laundry amount") accommodated in the drum 124 by driving the drive unit 113 to set a target water level. In the laundry amount detection step 210, the laundry amount may be measured in various manners. In the embodiment, the laundry amount is measured in such a manner that, after the drive unit 113 rotates the drum 124 at a fixed speed for a certain time, the control unit 141 measures a deceleration time. The longer the deceleration time of the drum 124, the greater the detected laundry amount. In the embodiment, the control unit 141 may calculate the laundry amount by measuring an acceleration time when the drum 124 is accelerated.

The control unit 141 sets a target water level according to the detected laundry amount. The target water level is a target amount of wash water which will be supplied into the tub 122 after the completion of a wash water step 220. The control unit 141 controls the water supply unit 132 until the water level detected by the water level sensor 121 reaches the target water level in the wash water supply step 220, and supplies wash water into the tub 122. In addition, the control unit 141 determines an operation time for each process according to the detected laundry amount.

The wash water supply step 220 is a step of performing preliminary washing before a washing step 230, by mixing wash water supplied from the external water source with detergent, supplying the wash water into the tub 122, and wetting laundry in the wash water mixed with the detergent. A detailed description of the wash water supply step 220 will be given below with reference to FIG. 7.

The washing step 230 is a step of repeatedly tumbling laundry by rotating the drum 124 at various speeds or in various directions, so as to remove contaminants from the laundry by applying mechanical forces, such as bending-stretching force, frictional force, and impulsive force, to the laundry.

In the washing step 230, laundry may be tumbled in such a manner that the laundry is lifted by the lifter 124*a* and is then dropped when the drive unit 113 rotates the drum 124.

In the embodiment, in the washing step 230, the drive unit 113 may rotate the drum 124 such that laundry rotates in the state of being attached to the drum 124, and the pump 136 may circulate wash water along the circulation hose 137 so that the wash water is sprayed into the drum 124 through the circulation nozzle 139. In this case, the drive unit 113 may rotate the drum 124 at a speed higher than 108 RPM (revolutions per minute), and the control unit 141 may stop the drive unit 113 at intervals of several seconds to several minutes in order to prevent the drive unit 113 from overheating.

In the washing step 230, the control unit 141 opens the bleach valve 132*c* of the water supply unit 132, thereby enabling wash water to be mixed with bleach in the detergent box 133 and then introduced into the tub 122 through the water supply pipe 134. The wash water mixed with the bleach is preferably supplied immediately before the washing step 230 is completed.

A rinsing-dehydration step 240 is a step of performing preliminary rinsing before a rinsing step 260 by spraying wash water supplied from the external water source while accelerating the drum 124 at a high speed such that wash water, in which laundry is wet, is discharged. A detailed description of the rinsing-dehydration step 240 will be given below with reference to FIG. 8.

A rinsing water supply step 250 is a step of supplying wash water into the tub 122. In the rinsing water supply step 250, the control unit 141 intermittently or continuously operates the water supply unit 132 to supply wash water, which is mixed with fabric softener, into the tub 122. In the rinsing water supply step 250, it is preferable that the drive unit 113 rotate the drum 124 so that laundry is wet in the wash water mixed with the fabric softener.

The rinsing step 260 is a step of rotating the drum 124 accommodating laundry. In the rinsing step 260, the control unit 141 controls the drive unit 113 to rotate the drum 124 at various rotational speeds or in various directions, thereby repeatedly tumbling laundry so as to remove residual detergent and contaminants from the laundry by applying mechanical forces, such as bending-stretching force, frictional force, and impulsive force, to the laundry.

In the embodiment, in the rinsing step 260, the drive unit 113 may rotate the drum 124 such that laundry rotates in the state of being attached to the drum 124, and the control unit 141 operates the pump 136 so that wash water is circulated along the circulation hose 137 to be sprayed into the drum 124 through the circulation nozzle 139.

A regular dehydration step 270 is a step of rotating the drum 124 at a high speed such that wash water, in which laundry is wet, is discharged. In the regular dehydration step 270, it is preferable that the drive unit 113 rotate the drum 124 to a rotational speed equal to or higher than 1000 RPM such that laundry is dried to the maximum level. The drum 124 in the regular dehydration step 270 preferably has a maximum rotational speed higher than that of the drum 124 in the rinsing-dehydration step 240.

In the regular dehydration step 270, it is preferable that the control unit 141 operate the pump 136 for several seconds at intervals of several seconds to several minutes such that the wash water in the tub 122 is discharged along the drain hose 138 to the outside. In the embodiment, the pump 136 may be operated for a certain time before the drum 124 is accelerated and rotated at a high speed, and may discharge the wash water in the tub 122 to the outside.

Figure 7:
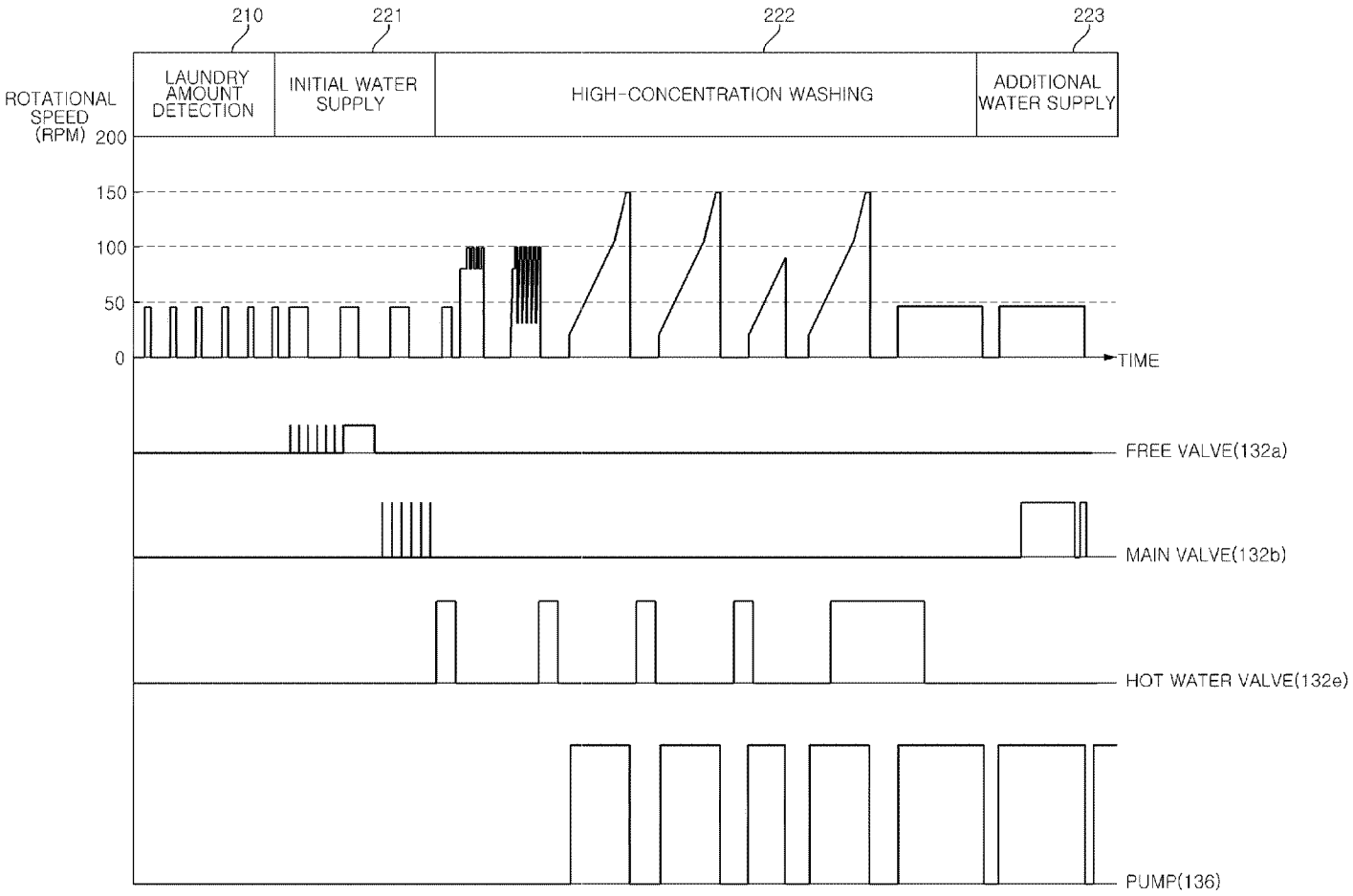
FIG. 7 is a view illustrating a control method of the washing machine in a wash water supply step according to the embodiment of the present invention.

FIG. 7 is a view illustrating a control method of the washing machine in the wash water supply step according to the embodiment of the present invention.

The control method of the washing machine according to the embodiment of the present invention includes an initial water supply step 221 in which the water supply unit 132 supplies wash water into the tub 122 such that the level of the wash water is lower than a target water level, a high-concentration washing step 222 in which the drive unit 113 accelerates the drum 124 and the pump 136 circulates wash water so that the wash water is sprayed into the drum 124 through the circulation nozzle 139, and an additional water supply step 223 in which the water supply unit 132 supplies wash water into the tub 122 until the level of the wash water reaches a target water level.

When the laundry amount detection step 210 is completed and the target water level is set, the control unit 141 performs the initial water supply step 221. The laundry amount detection step 210 has been described above.

In the initial water supply step 221, the control unit 141 controls the water supply unit 132 to supply wash water into the tub 122 such that the level of the wash water is lower than the target water level.

In the initial water supply step 221, the control unit 141 opens the free valve 132*a* to supply wash water from the cold water source C.W as the external water source. When the free valve 132*a* is opened, wash water is supplied to the detergent box 133 through the first water supply hose 131*a*. When preliminary washing detergent is present in the detergent box 133, the wash water supplied to the detergent box 133 is mixed with the preliminary washing detergent, and is then supplied into the tub 122 through the water supply pipe 134. When no preliminary washing detergent is present in the detergent box 133, the wash water supplied by the free valve 132*a* is supplied into the tub 122 through the water supply pipe 134 without being mixed with preliminary washing detergent. The control unit 141 controls the free valve 132*a* to intermittently supply wash water, thereby allowing the wash water to be smoothly mixed with the detergent.

When the supply of the wash water by the free valve 132*a* is completed, the control unit 141 opens the main valve 132*b* to supply wash water from the cold water source C.W as the external water source. When the main valve 132*b* is opened, wash water is supplied to the detergent box 133 through the second water supply hose 131*b*. The wash water supplied by the main valve 132*b* is mixed with washing detergent by passing through the detergent accommodation portion of the detergent box 133, and is then supplied into the tub 122 through the water supply pipe 134. The control unit 141 controls the main valve 132*b* to intermittently supply wash water, thereby allowing the wash water to be smoothly mixed with the detergent.

In the initial water supply step 221, the control unit 141 drives the drive unit 113 to rotate the drum 124. When the free valve 132*a* and/or the main valve 132*b* are intermittently opened, the control unit 141 rotates the drum 124 so that laundry rolls in the drum 124 to be wet in wash water mixed with detergent. In the initial water supply step 221, the drum 124 preferably rotates at a speed of about 46 RPM such that laundry rolls in the drum 124. The control unit 141 controls the drive unit 113 to intermittently rotate the drum 124 at intervals of several seconds.

The control unit 141 supplies wash water into the tub 122 such that the level of the wash water is lower than the target water level set by the laundry amount step 210 and higher than a minimum water level in which the wash water may is circulated by the pump 136. Preferably, the control unit 141 supplies wash water into the tub 122 such that the wash water does not come into contact with the lower portion of the drum 124. The control unit 141 sets a water level, which is lower than the set target water level, as an initial water level, and control the main valve 132*b* until the water level detected by the water level sensor 121 reaches the initial water level so as to supply wash water into the tub 122.

When the supply of the wash water by the free valve 132*a* and the main valve 132*b* is completed, the control unit 141 performs the high-concentration washing step 222.

In the high-concentration washing step 222, the control unit 141 drives the drive unit 113 to accelerate the drum 124 such that laundry rotates in the state of being attached to the drum 124, and sprays wash water, which is circulated by the driving of the pump 136, into the drum 124 through the circulation nozzle 139.

The control unit 141 accelerates the drum 124 to a rotational speed of 150 RPM such that laundry rotates in the state of being attached to the drum 124. The control unit accelerates the drum 124 to spray wash water into the drum 124 through the circulation nozzle 139. When the drum 124 is accelerated, the control unit 141 drives the pump 136 so that wash water is circulated along the circulation hose 137. The wash water, which is circulated by the pump 136 when the drum 124 is accelerated, is sprayed into the drum 124 through the circulation nozzle 139.

The control unit 141 preferably accelerates the drum 124 to a rotational speed at which the resonance of the washing machine 100 is not generated even when the laundry rotates in the state of being attached to the drum 124. In the embodiment, the target rotational speed is 150 RPM.

When the drum 124 reaches the speed of 150 RPM as the target rotational speed, the control unit 141 brakes the drive unit 113 to brake the drum 124, and stops the pump 136 to stop the injection of wash water through the circulation nozzle 139. That is, when the drum 124 is accelerated and then braked, the control unit 141 controls the pump 136 to stop the injection of the circulated wash water.

In the high-concentration washing step 222, the control unit 141 repeats the acceleration and braking of the drum 124 at intervals of several seconds. The control unit 141 drives the pump 136 whenever the drum 124 is repeatedly accelerated, and repeats the injection of wash water into the drum 124 through the circulation nozzle 139.

Since wash water is supplied into the tub 122 such that the level of the wash water is lower than the target water level in the initial water supply step 221, high-concentration wash water having the high ratio of detergent to wash water is accommodated in the tub 122. The high-concentration wash water is sprayed onto laundry through the circulation nozzle 139 during the acceleration of the drum 124 to remove contaminants from the laundry, thereby allowing preliminary washing to be performed before the washing step 230.

In the high-concentration washing step 222, it is preferable that the control unit 141 drive the drive unit 113 before the drum 124 is accelerated to the speed of 150 RPM to repeat the acceleration and deceleration of the drum 124, so as to simply distribute laundry.

In the high-concentration washing step 222, the control unit 141 opens the hot water valve 132*e* to supply hot wash water from the hot water source H.W as the external water source. When the hot water valve 132*e* is opened, hot wash water is supplied to the detergent box 133 through the fifth water supply hose 131*e*. The wash water supplied by the hot water valve 132*e* is supplied into the tub 122 through the water supply pipe 134. The control unit 141 opens the hot water valve 132*e* for several seconds at intervals of several seconds to several minutes to supply the hot wash water in the tub 122.

The wash water may be supplied at any time by the hot water valve 132*e* in the high-concentration washing step 222. The hot water valve 132*e* may be opened regardless of the driving of the drive unit 113 or the driving of the pump 136. That is, the control unit 141 opens the hot water valve 132*e* before, after, or while the drum 124 is accelerated and wash water is sprayed into the drum 124, thereby enabling the hot wash water to be supplied into the tub 122.

In the high-concentration washing step 222, hot wash water may be supplied and thus detergent may be well dissolved in the wash water.

When the repetition of the acceleration and braking of the drum 124 is completed, the control unit 141 drives the drive unit 113 so that the drum 124 rotates at a constant speed and is then stopped. When the drum 124 rotates at a constant speed, the control unit 141 may drive the pump 136 to spray wash water into the drum 124 through the circulation nozzle 139.

When the repetition of the acceleration and braking of the drum 124 is completed, the control unit 141 performs the additional water supply step 223.

In the additional water supply step 223, the control unit 141 controls the main valve 132*b* to supply wash water until the target water level.

The control unit 141 opens the main valve 132*b* to supply wash water from the cold water source C.W as the external water source. When the main valve 132*b* is opened, wash water is supplied to the detergent box 133 through the second water supply hose 131*b*. The wash water supplied by the main valve 132*b* is supplied into the tub 122 through the water supply pipe 134.

The control unit 141 intermittently opens the main valve 132*b* until the water level detected by the water level sensor 121 reaches the target water level, and supplies wash water into the tub 122.

In the additional water supply step 223, the control unit 141 drives the drive unit 113 so that the drum 124 may rotate at a constant rotational speed and then be stopped. In the additional water supply step 223, the control unit 141 may drive the pump 136 to spray the circulated wash water into the drum 124 through the circulation nozzle 139. Preferably, the wash water, which is circulated when the drum 124 rotates at a constant rotational speed, is sprayed into the drum 124.

When the water level detected by the water level sensor 121 reaches the target water level in the additional water supply step 223, the control unit 141 completes the additional water supply step 223, and performs the above-mentioned washing step 230. In the embodiment, the washing step 230 is preferably a typical washing step in which the drive init 113 rotates the drum 124 so as to remove contaminants from laundry. In the washing step 230, the control unit 141 drives the drive unit 113 to rotate the drum 124, so that laundry is lifted by the lifter 124*a* and is then dropped, namely is tumbled.

Figure 8:
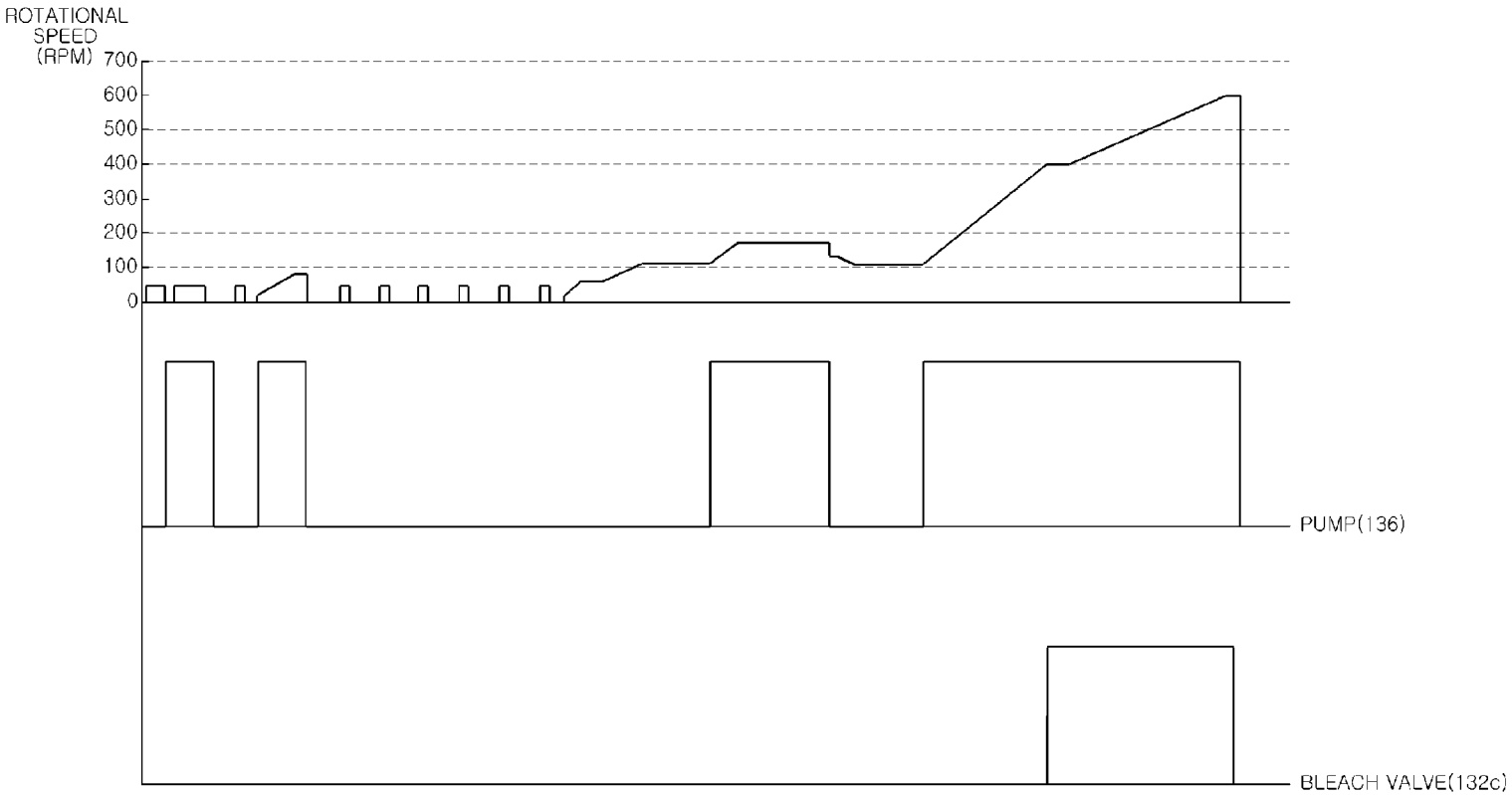
FIG. 8 is a view illustrating a control method of the washing machine in a rinsing-dehydration step according to the embodiment of the present invention.

FIG. 8 is a view illustrating a control method of the washing machine in the rinsing-dehydration step according to the embodiment of the present invention.

The control method of the washing machine according to the embodiment of the present invention includes the rinsing-dehydration step 240 of spraying wash water, which is supplied from the external water source by the water supply unit 132, into the drum 124 through the injection nozzle 151 while accelerating the drum 124 at a high speed by the drive unit 113 such that wash water, in which laundry is wet, is discharged.

When the washing step 230 is completed, the control unit 141 performs the rinsing-dehydration step 240.

In the rinsing-dehydration step 240, the control unit 141 drives the drive unit 113 to accelerate the drum 124 such that wash water, in which laundry is wet, is discharged. Sine laundry is not required to be completely dried in the rinsing-dehydration step 240, the drive unit 113 accelerates the drum 124 to a speed of 600 RPM which is lower than the rotational speed in the regular dehydration step 270.

The control unit 141 accelerates the drum 124 and controls the bleach valve 132*c* so as to spray wash water, which is supplied from the cold water source C.W as the external water source, into the drum 124 through the injection nozzle 151.

When the bleach valve 132*c* is opened during the acceleration of the drum 124, wash water is supplied to the injection nozzle 151 through the third water supply hose 131*c*. The wash water supplied by the bleach valve 132*c* is sprayed into the drum 124 through the injection nozzle 151.

The wash water, which is supplied from the external water source during the acceleration of the drum 124, is sprayed into the drum 124 so as to remove residual detergent and contaminants from laundry, thereby allowing preliminary rinsing to be performed before the rinsing step 260.

In the rinsing-dehydration step 240, it is preferable that the control unit 141 drive the drive unit 113 before the drum 124 is accelerated to the speed of 600 RPM to repeat the acceleration and deceleration of the drum 124, so as to distribute laundry.

In the rinsing-dehydration step 240, it is preferable that the control unit 141 operate the pump 136 for several seconds at intervals of several seconds to several minutes so that the wash water in the tub 122 is discharged along the drain hose 138 to the outside. When the laundry is distributed before the drum 124 is accelerated and rotates at a high speed, the pump 136 is preferably operated for a certain time so that the wash water in the tub 122 is discharged to the outside. In addition, the pump 136 is preferably operated when the bleach valve 132*c* is opened and wash water is sprayed into the drum 124 through the injection nozzle 151 so that the wash water in the tub 122 is discharged to the outside.

The control unit 141 controls the drive unit 113 to stop the drum 124, closes the bleach valve 132*c* to stop the injection of the wash water, and stops the operation of the pump 136 to stop drainage. Thereby, the rinsing-dehydration step 240 is completed. When the rinsing-dehydration step 240 is completed, the control unit 141 performs the above-mentioned rinsing water supply step 250.

Figure 9:
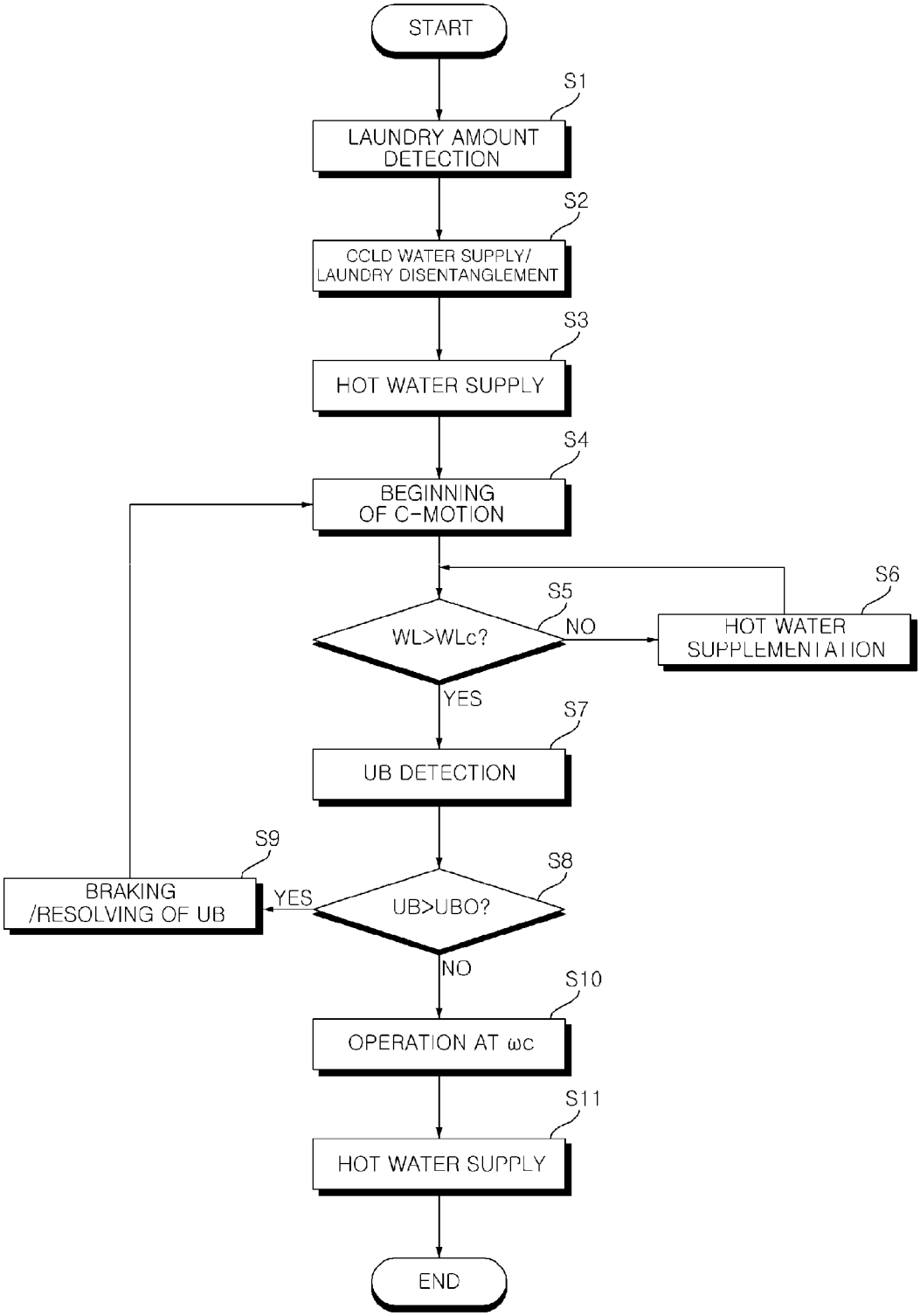
FIG. 9 is a flowchart illustrating a method of controlling a washing machine according to another embodiment of the present invention.
Figure 10:
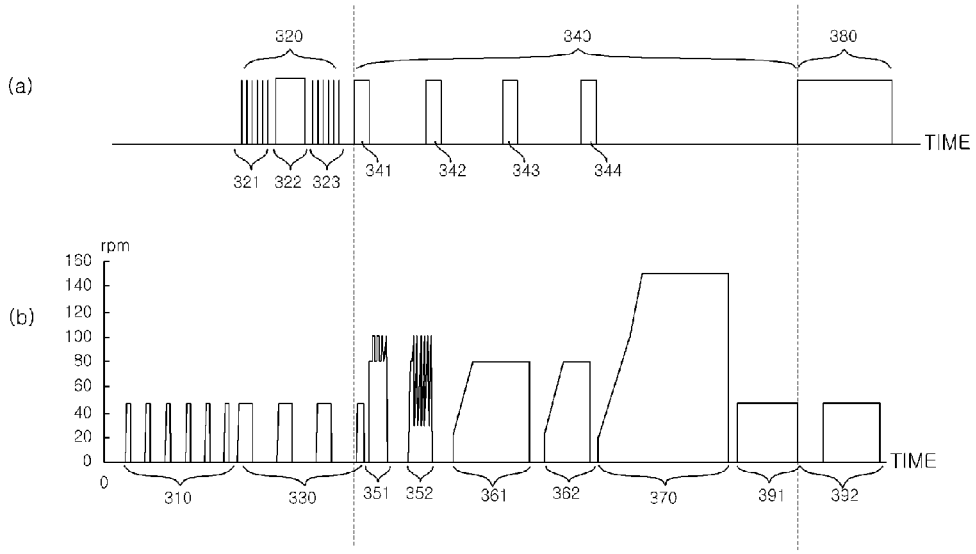
FIG. 10 is a view for explaining the method of controlling a washing machine according to another embodiment of the present invention, wherein (a) is a graph illustrating a water supply process over time, and (b) is a graph illustrating a change in rotational speed of a drum over time.
Figure 11:
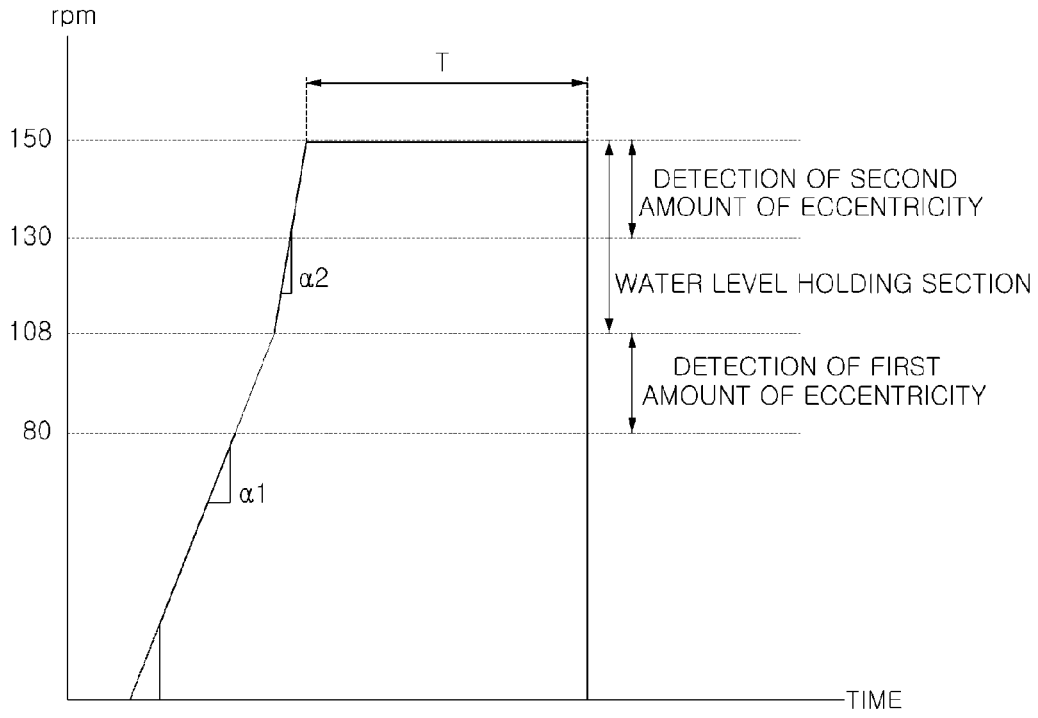
FIG. 11 is a detailed view illustrating the change in rotational speed of the drum over time in a C-motion step in FIG. 10.
Figure 12:
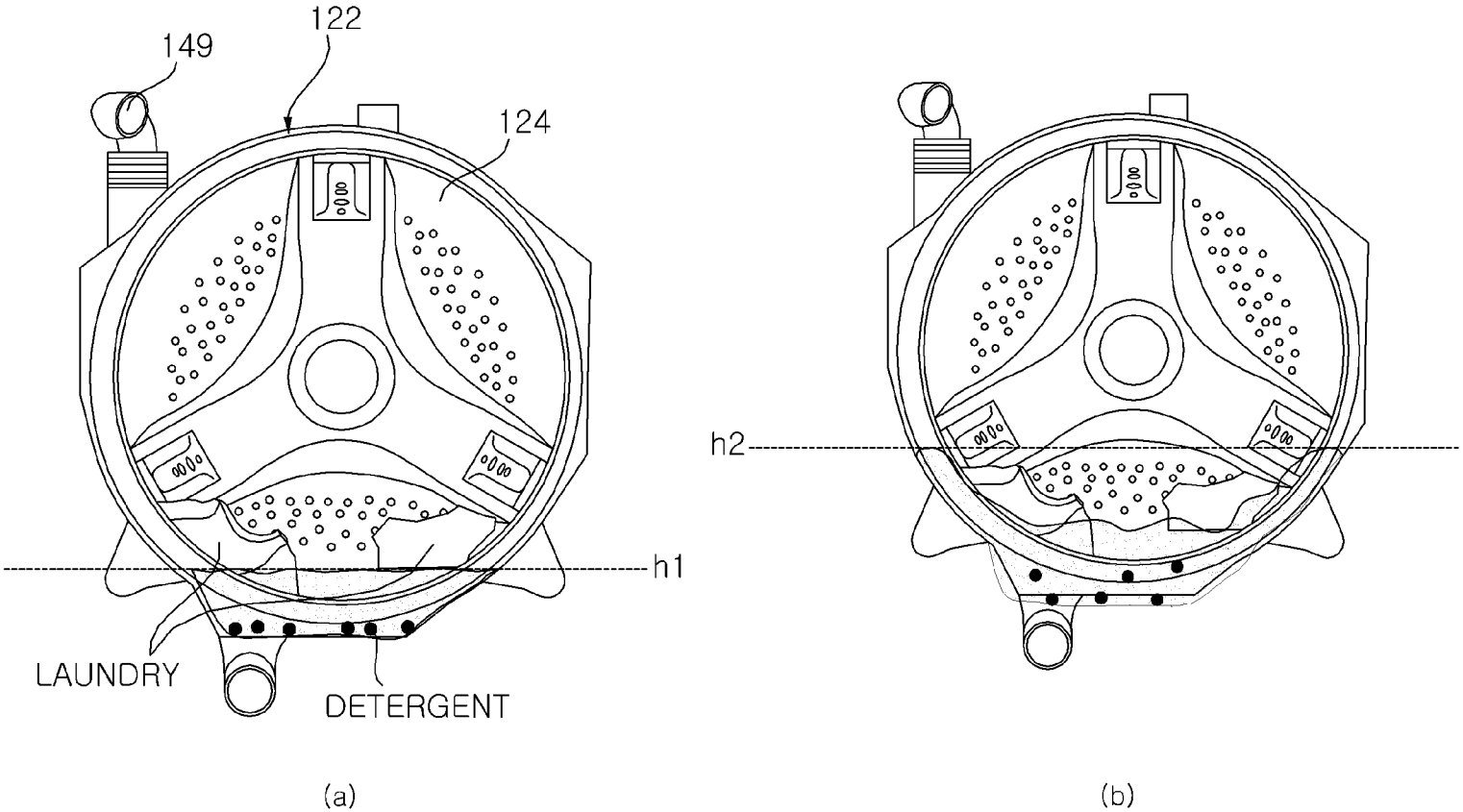
FIG. 12 is a view for explaining an increase in water level induced by execution of a C-motion, wherein (a) is a view illustrating a water level before the execution of the C-motion, and (b) is a view illustrating a water level during the execution of the C-motion.

FIG. 9 is a flowchart illustrating a method of controlling a washing machine according to another embodiment of the present invention. FIG. 10 is a view for explaining the method of controlling a washing machine according to another embodiment of the present invention, wherein (a) is a graph illustrating a water supply process over time, and (b) is a graph illustrating a change in rotational speed of a drum over time. FIG. 11 is a detailed view illustrating the change in rotational speed of the drum over time in a C-motion step in FIG. 10. FIG. 12 is a view for explaining an increase in water level induced by execution of a C-motion, wherein (a) is a view illustrating a water level before the execution of the C-motion, and (b) is a view illustrating a water level during the execution of the C-motion.

Hereinafter, the method of controlling a washing machine according to another embodiment of the present invention will be described with reference to FIGS. 9 to 12.

The washing machine according to another embodiment of the present invention, which will be described below, has a configuration except for the injection nozzle 151, the circulation hose 137, and the circulation nozzle 139 in the washing machine according to the above-mentioned embodiment. The pump 136 of the washing machine according to another embodiment of the present invention has only a drain function without the wash water circulation function. In addition, the free valve 132*a*, the main valve 132*b*, and the bleach valve 132*c* of the washing machine according to the above-mentioned embodiment are collectively referred to as cold water valves 132*a*, 132*b*, and 132*c* of the washing machine according to another embodiment of the present invention.

In the washing machine according to another embodiment of the present invention, wash water supplied from the outside is not sprayed into the drum 124, and is not sprayed into the drum 124 through the circulation thereof.

When the washing course, which is set through the input part 114*b*, is executed, a laundry amount detection step S1 (310) of detecting an amount of laundry inserted into the drum 124 is first executed. In the laundry amount detection step 310, the laundry amount is detected by the control unit 141. The method of detecting the laundry amount by the control unit 141 is identical to that in the laundry amount detection step 210 of the washing method of the washing machine according to the above embodiment.

When the laundry amount is determined, the control unit 141 may set a target water level, a water supply pattern, a washing pattern, a washing time, a water level for each process, a holding time (T) of C-motion to be described later, etc., according to the determined laundry amount.

The control unit 141 may control the water supply unit 132 such that wash water is supplied to the tub 122 until the level of the wash water reaches the target water level set according to the laundry amount. The wash water supply may be classified into a time-based water supply step in which water is supplied based on the opening time of the water supply unit 132, and a water level-based water supply step in which water is supplied based on the water level in the tub 122.

In the time-based water supply step, the control unit 141 may control the opening and/or closing time of the water supply unit 132 according to a predetermined condition. Here, the opening and closing times of the water supply unit 132 may be set according to the laundry amount detected in the laundry amount detection step 310. FIG. 10 illustrates (a) the water supply pattern and (b) the drive pattern of the drum 124, when the laundry amount detected in the laundry amount detection step 310 is equal to or less than a predetermined reference laundry amount (hereinafter, referred to as a "small amount of laundry").

The time-based water supply step may include a cold water supply step S2 (320) and a hot water supply step S3 (340). In the cold water supply step, the opening and closing of the cold water valves 132*a*, 132*b*, and 132*c* may be repeated for a short time (321 and 323), or may the cold water valves 132*a*, 132*b*, and 132*c* may be maintained in the opened state for a predetermined time which is longer than the above time (322). Particularly, in the steps of 321 and 322, wash water, in which detergent is not dissolved, i.e. raw water may be supplied into the tub 122. In addition, in the step of 323, water may be supplied to a detergent accommodation part, or the opening and closing of the cold water valves 132*a*, 132*b*, and 132*c* may be periodically repeated for a very short time.

In the state in which the cold water supply step 320 is completed, the level of water in the tub 122 is preferably lower than the target water level. The level of water in the tub 122 may not come into contact with the drum 124. However, the water level preferably comes into contact with the lower end portion of the drum 124 such that a small amount of wash water may be introduced into the drum 124 through the through-holes 124*b*.

In the hot water supply step S3 (340), the hot water valve 132*a* may be repeatedly opened and closed. In the embodiment, hot water is supplied four times (341, 342, 343, and 343). The amount of hot water supplied each time may be controlled based on the opening time of the hot water valve 132*e*. In the embodiment, hot water is supplied on a regular period, the opening time of the hot water valve 132*e* is the longest time when the hot water is supplied once (341), and the opening time of the hot water valve 132*e* is regularly controlled each time when the hot water is supplied two to four times (342, 343, and 344).

The detergent accommodation part of the detergent box 133 may be provided with a siphon device. The siphon device is configured such that the wash water remaining in the detergent accommodation part may be discharged to the tub 122 by the siphon principle even though the water is not supplied. After the hot water is supplied each time, the hot water valve 132*e* is maintained for a certain time in the closed state. In this case, the wash water is discharged from the detergent box 133 through the siphon device for the certain time.

Meanwhile, the control unit 141 may control the drive unit 113 such that the drum 124 is repeatedly rotated and stopped during the supply of water (330). The rotational speed of the drum 124 is preferably set within a range in which the position of laundry may be changed in the drum 124. In this case, the drive unit 113 rotates the drum 124 so that laundry is lifted by the lifter 124*a* and is then dropped, namely is tumbled. The step of 330 is mainly aimed to evenly distribute the entangled laundry within the drum 124, and is hereinafter referred to as a laundry disentanglement step S2. In the embodiment, the speed of the drum 124 in the laundry disentanglement step S2 (330) is a speed of about 40 RPM which is equal to that in the laundry amount detection step S1 (310), but the present invention is not limited thereto.

During the execution of the hot water supply step 340, the drum 124 may be rotated in various patterns. For example, the drum 124 may be rotated by repeating acceleration and deceleration (351 and 352), or the drum 124 may be controlled such that, when the drum 124 is accelerated and reaches a set speed, the drum 124 rotates in the state of being maintained at the set speed for a certain time (361 and 362).

In the embodiment, in the step of 351, the rotational speed of the drum 124 is repeatedly increased to a speed of 100 RPM and decreased to a speed of 80 RPM. In the step of 352, the rotational speed of the drum 124 is repeatedly increased to a speed of 100 RPM and decreased to a speed of 30 RPM.

In the steps of 361 and 362, a section is provided in which the rotation of the drum 124 is regularly controlled at a set speed of about 80 RPM. In this speed of 80 RPM, a considerable amount of laundry rotates together with the drum 124 in the state of being attached to the drum 124 by centrifugal force. In this case, the laundry attached to the inner peripheral surface of the drum 124 is lifted to a maximum height by the rotation of the drum 124, and is not dropped.

The C-motion step S4 to S10 (370) may include a step of accelerating the drum 124 to a predetermined set speed (ωc), and a step of controlling the drum 124 such that the drum 124 rotates while being maintained at the set speed (ωc).

In the step of accelerating the drum 124 to a predetermined set speed (ωc) of the C-motion step 370, the drum 124 is accelerated such that the wash water in the tub 122 along the gap between the tub 122 and the drum 124. Before the C-motion step 370 is performed, the detergent and the wash water are already supplied to the tub 122 (320 and 340), especially the tub 122 is filled with the wash water enough to sink a portion of the drum 124. Accordingly, in the C-motion step 370, the drum 124 generates the flow of wash water in the tub 122 by frictional action with the wash water. According to the experiment of the present applicant, in the C-motion step 370, the flow of wash water in the drum 124 is formed in the lower portion of the drum 124 such that the wash water is discharged to the tub 122 through the through-holes 124*b*. As a result, a phenomenon is identified in which the level of water rises between the tub 122 and the drum 124. The wash water, the level of which rises, is again introduced into the drum 124 through the through-holes 124*b*, especially the wash water is guided along the gasket 128 to be again introduced into the drum 124 through the opening portion in front of the drum 124. In the C-motion step 370, the wash water is twisted by the rotated drum 124 so that the ability to dissolve the detergent is improved. Particularly, the flow of wash water introduced into the drum 124 from the tub 122 is formed as described above, thereby enabling the laundry in the drum 124 to be sufficiently wet in the small amount of wash water. In this case, the detergent concentration of the wash water, which is absorbed to the laundry, is higher compared to after an additional water supply step 380 is performed after the C-motion step 370. That is, since the laundry is wet in the detergent water having a high concentration in the C-motion step 370, contaminants may be actively treated by chemical action of detergent.

In the C-motion step 370, the control unit 141 may detect an amount of eccentricity during the acceleration of the drum 124 (S7). In this case, a section, in which the amount of eccentricity is detected, is preferably set to exclude the generation section of resonance. According to the experiment of the present applicant, in the washing machine according to the embodiment of the present invention, it is identified that the resonance is generated in the section between 108 RPM and 130 RPM. Thus, in the embodiment, the amount of eccentricity is detected in the section which is set to exclude the above section.

The control unit 141 may determine whether to continuously rotate or brake the drum 124 based on the amount of eccentricity (UB) detected during the execution of the C-motion. That is, when the detected amount of eccentricity (UB) is equal to or less than a predetermined allowable amount of eccentricity (UB0) (S8), the control unit 141 accelerates the drum 124 to a target speed (ωc) and controls the drum 124 such that the drum 124 rotates while being maintained at the set speed (ωc) (S10). In contrast, the control unit 141 may control the rotation of the drum 124 in a predetermined pattern for resolving the eccentricity (S9).

The amount of eccentricity may be detected in two or more sections during the acceleration of the drum 124. In the embodiment, the amount of eccentricity is detected in each of the section between 80 RPM and 108 RPM (first acceleration section) and the section between 130 RPM and 150 RPM (second acceleration section). In order to distinguish the amount of eccentricity detected in the first acceleration section from the amount of eccentricity detected in the second acceleration section, the former is referred to as a first amount of eccentricity and the latter is referred to as a second amount of eccentricity.

Although the drum 124 is illustrated to have an acceleration value different from α1 in the initial driving step in the drawings, the present invention is not limited thereto. For example, as indicated by the dotted line, the drum 124 may also be accelerated at a constant acceleration of al from the stopped state.

The drum 124 may be accelerated at different accelerations (rpm/s) in the first and second acceleration sections. Preferably, the acceleration (α2) in the second acceleration section is greater than the acceleration (α1) in the first acceleration section. In the initial acceleration step of the drum 124, the speed of the drum 124 is increased with a gentle gradient, and thus it is possible to sufficiently secure the flow time of laundry in the drum 124. Accordingly, the laundry may be attached to the inner peripheral surface of the drum 124 so as to be evenly distributed thereon, in the state in which the rotational speed of the drum 124 reaches an upper limit speed in the first acceleration section. The upper limit speed in the first acceleration section is preferably enough to generate sufficient centrifugal force such that the laundry in the drum 124 rotates together in the state of being attached to the drum 124. In the embodiment, the upper limit speed in the first acceleration section is a speed of 108 RPM. In this speed, the laundry is rotated in the state of being attached to the drum 124.

Meanwhile, when the first amount of eccentricity is less than the predetermined allowable amount of eccentricity, the control unit 141 may continuously accelerate the drum 124. However, when the first amount of eccentricity is greater than the allowable amount of eccentricity, the control unit 141 may control the drive unit 113 to brake the drum 124. After the drum 124 is braked, the control unit 141 may control the rotation of the drum 124 in a predetermined pattern in order to redistribute the laundry in the drum 124. In this case, the drum 124 may be repeatedly rotated at a low speed as in the step of 330. After the laundry is redistributed, the C-motion may be performed again.

The second acceleration section is a section after the first acceleration section. Preferably, the second acceleration section continues from the first acceleration section, and terminates when the rotational speed of the drum 124 reaches the set speed (150 RPM). In the second acceleration section, the entire laundry rotates together with the drum 124 in the state of being attached to the drum 124.

A resonance section is present in the second acceleration section. The acceleration in the second acceleration section is set to be higher than that in the first acceleration section ($\alpha 2 > \alpha 1$) such that the laundry rapidly passes through the resonance section.

The second amount of eccentricity may be detected in a section after the resonance section. In the embodiment, the second amount of eccentricity is detected in the section between 130 RPM and 150 RPM. When the second amount of eccentricity is less than a predetermined allowable amount of eccentricity, the control unit 141 may control the drive unit 113 such that the rotational speed of the drum 124 is maintained at the set speed ($\omega c$=150 RPM). In contrast, when the second amount of eccentricity is greater than the allowable amount of eccentricity, the control unit 141 may control the drive unit 113 to brake the drum 124. After the drum 124 is braked, the control unit 141 may control the rotation of the drum 124 in a predetermined pattern in order to redistribute the laundry in the drum 124. In this case, the drum 124 may be repeatedly rotated at a low speed as in the step of 330. After the laundry is redistributed, the C-motion may be performed again.

When the drum 124 is maintained at the set speed and is rotated, the level of water between the tub 122 and the drum 124 rises, and wash water is circulated between the tub 122 and the drum 124. Since this process continues for a set time (T), the laundry in the drum 124 may be sufficiently wet in the wash water mixed with detergent. For reference, in the drawings, reference numeral h1 refers to a water level before the C-motion is executed, and reference numeral h2 refers to a water level rising by the execution of the C-motion.

The control unit 141 may set a set time (T) according to the laundry amount detected in the laundry amount detection step 310. Particularly, the set time (T) is closely related with an amount of bubbles generated by the dissolved detergent. Therefore, when the set time (T) is too long, an excessive amount of bubbles may be generated in the drum 124. For this reason, the ability to wash and rinsing may be deteriorated. In addition, a communication port 149 for communicating between the inside of the tub 122 and outside air is formed in the tub 122 for ventilation. In this case, the excessive amount of bubbles may be leaked to the outside of the tub 122 through the communication port 149. Thus, the set time (T) is set to be shorter than a time required for bubbles to be generated until reaching the communication port 149.

Meanwhile, when the rotational speed of the drum 124 is increased, the level of water in the tub 122 may be detected by the water level sensor 121. The control unit 141 may supplement water by control of the water supply unit 132, based on the water level value detected by the water level sensor 121. When water is supplemented, cold water may be supplied into the tub 122, but hot water is preferably supplied thereto. The water level holding section illustrated in FIG. 11 is a section in which the level of water in the tub 122 is uniformly maintained through the supplementation of water. In the embodiment, the water level holding section corresponds to the second acceleration section and the section in which the drum 124 rotates at the set speed, but the present invention is not limited thereto. For example, water may also be supplemented in the first acceleration section and any section in which the drum 124 rotates at the set speed ($\omega c$) or less.

As such, in order to prevent the level of water in the tub 122 from being lowering until the drum 124 is not sunk due to causing laundry to absorb wash water, water is supplemented during the execution of the C-motion. Accordingly, when the detected water level is lower than a water level, in which the drum 124 begins to sink, during the execution of the C-motion, the control unit 141 may control the water supply unit 132 so as to additionally supplements water into the tub 122. Such water supplementation may be performed until the water level value (WL) detected by the water level sensor 121 reaches a predetermined water level (WLc) (S5 and S6). Alternatively, it is possible to control an amount of water supply based on the opening time of the water supply unit 132.

After the C-motion is executed, an additional wash water supply step 380 may be performed in order to additionally supply wash water into the tub 122. The additional wash water supply step 380 is a water level-based water supply step. In this step, water is additionally supplied until a target water level set according to the laundry amount in a series of processing processes such as washing and rinsing performed after the completion of water supply. Preferably, cold water is supplied.

In addition, after the C-motion is executed, the drum 124 may be repeatedly rotated at a low speed (about 40 RPM) for a predetermined time (391 and 392). The rotation of the drum 24 may also be performed (392) during the additional supply of wash water (380).

Figure 13:
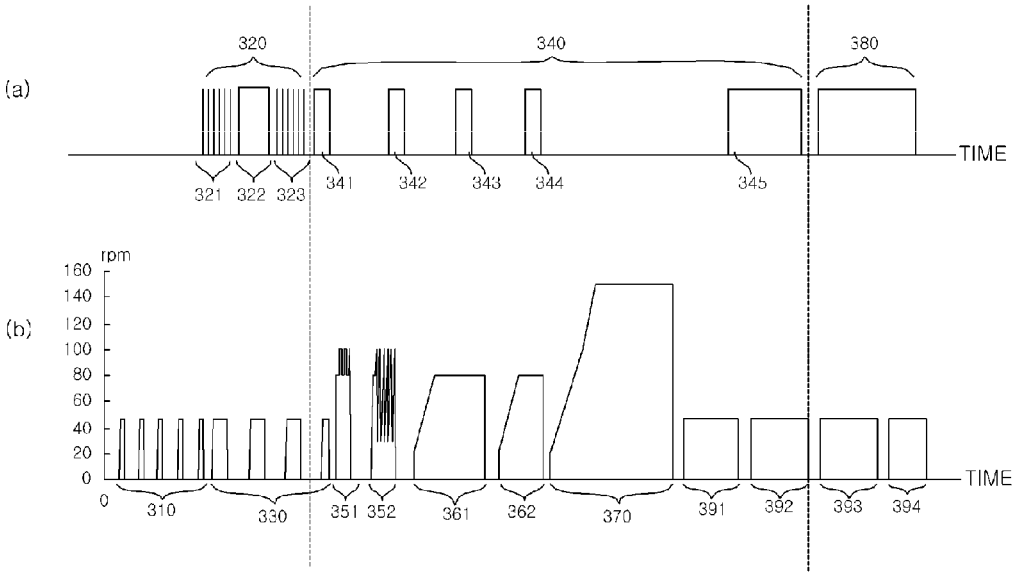
FIG. 13 is a view for explaining a method of controlling a washing machine according to a further embodiment of the present invention, wherein (a) is a graph illustrating a water supply process over time, and (b) is a graph illustrating a change in rotational speed of a drum over time.

FIG. 13 is a view for explaining a method of controlling a washing machine according to a further embodiment of the present invention, wherein (a) is a graph illustrating a water supply process over time, and (b) is a graph illustrating a change in rotational speed of a drum over time. Particularly, FIG. 13 illustrates (a) the water supply pattern and (b) the drive pattern of the drum 124, when the laundry amount detected in the laundry amount detection step 310 is equal to or greater than a predetermined reference laundry amount (hereinafter, referred to as a "large amount of laundry"). Hereinafter, the same reference numbers will be used throughout the drawings to refer to the same or like parts, and the description thereof follows the above-mentioned description.

Referring to FIG. 13, the method of controlling a washing machine according to the further embodiment of the present invention differs from the above-mentioned embodiments in that the hot water supply step 340 is again performed after the completion of the C-motion 370. In particularly, a hot water supply step 345 performed after the completion of the C-motion 370 may be performed for a longer time than the previously performed hot water supply steps 341 to 344.

The hot water supply step 345 is added. Thus, in order to correspond to a water supply time according to the added step, steps 391, 392, 393, and 394 in which the drum 124 rotates at a low speed (about 40 RPM) may be more repeatedly performed compared to the above-mentioned embodiments.

As is apparent from the above description, the washing machine and the method of controlling the same according to the present invention have one or more effects described below.

First, it is possible to enhance washing performance and reduce a washing time by spraying high-concentration wash water having the high ratio of detergent to wash water onto laundry during the acceleration of the drum, so as to perform high-concentration washing for removing contaminants from the laundry.

Secondly, it is possible to perform preliminary ringing by spraying wash water supplied from the external water source into the drum when the drum is accelerated for dehydration such that wash water, with which laundry is wet, is discharged, so as to remove residual detergent and contaminants.

Thirdly, it is possible to completely dissolve detergent by supplying hot water during the high-concentration washing.

Fourthly, it is possible to effectively wet laundry inserted into the drum even when the level of water in the tub is low in the water supply process.

Fifthly, it is possible to improve the ability to remove contaminants from laundry using detergent by forcibly introducing wash water, having dissolved detergent in the tub, into the drum in the state in which the level of water in the tub is low.

Sixthly, it is possible to introduce wash water into the drum from the tub without using a circulation pump.

The present invention is not limited to the foregoing effects, and other effects thereof will be clearly understood by those skilled in the art from the following claims.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling a washing machine including a tub accommodating wash water, and a drum rotatably arranged in the tub and accommodating laundry, the method comprising:

performing laundry amount detection and setting a target water level by rotating the drum and detecting an amount of the laundry accommodated in the drum;

performing initial water supply by supplying the wash water into the tub such that a level of the wash water is lower than the target water level;

performing high-concentration washing at the level of the wash water that is lower than the target water level by accelerating the drum to a rotational speed at which the laundry is held against the drum; and performing additional water supply by supplying the wash water into the tub until the target water level is achieved, wherein, in the performing of the high-concentration washing, when the drum is accelerated, the drum is accelerated at a first acceleration, and is then accelerated at a second acceleration greater than the first acceleration, and wherein when the drum is accelerated at the second acceleration during the performing of the high-concentration washing, the level of water in the tub is detected, and when the detected level of water is equal to or less than a prescribed water level, additional water is supplied into the tub.

2. The method according to claim 1, wherein, in the performing of the high-concentration washing, circulated wash water is sprayed into the drum.

3. The method according to claim 2, wherein, in the performing of the high-concentration washing, injection of the wash water is stopped when the drum is accelerated and then braked.

4. The method according to claim 1, wherein, in the performing of the additional water supply, the wash water is sprayed into the drum.

5. The method according to claim 1, wherein, in the performing of the high-concentration washing, hot wash water, which is at a temperature hotter than a temperature of water from an external water source, is sprayed into the tub before, after, or while the drum is accelerated.

6. The method according to claim 1, wherein, in the performing of the initial water supply, the drum is intermittently rotated.

7. The method according to claim 1, wherein, in the performing of the additional water supply, the drum rotates at a constant speed.

8. The method according to claim 1, wherein, in the performing of the initial water supply, the wash water is intermittently supplied into the tub.

9. The method according to claim 1, wherein, in the performing of the high-concentration washing, an amount of eccentricity is detected when the drum is accelerated, and the drum is braked when the detected amount of eccentricity is equal to or greater than a predetermined allowable amount of eccentricity.

10. The method according to claim 1, wherein the prescribed water level correspond to a water level in which the drum begins to sink.

* * * * *